US010232280B2

(12) United States Patent
Koyun

(10) Patent No.: US 10,232,280 B2
(45) Date of Patent: Mar. 19, 2019

(54) MODULAR EDUCATION, ENTERTAINMENT AND TOY BLOCK

(71) Applicant: Ahmet Koyun, Besiktas/Istanbul (TR)

(72) Inventor: Ahmet Koyun, Besiktas/Istanbul (TR)

( * ) Notice: Subject to any disclaimer, the term of this patent is extended or adjusted under 35 U.S.C. 154(b) by 0 days.

(21) Appl. No.: 15/535,060

(22) PCT Filed: Dec. 4, 2015

(86) PCT No.: PCT/TR2015/050229

§ 371 (c)(1),
(2) Date: Jun. 11, 2017

(87) PCT Pub. No.: WO2016/093784

PCT Pub. Date: Jun. 16, 2016

(65) Prior Publication Data

US 2017/0361241 A1 Dec. 21, 2017

(30) Foreign Application Priority Data

Dec. 11, 2014 (TR) ..... 2014/14979
Dec. 11, 2014 (TR) ..... 2014/14980

(51) Int. Cl.
*A63H 33/08* (2006.01)
*A63H 33/10* (2006.01)

(52) U.S. Cl.
CPC ..... *A63H 33/084* (2013.01); *A63H 33/086* (2013.01); *A63H 33/105* (2013.01)

(58) Field of Classification Search
CPC ..... A63H 33/04; A63H 33/06; A63H 33/062; A63H 33/08; A63H 33/084; A63H 33/10; A63H 33/086
USPC ..... 446/85, 106, 115, 116, 122, 124, 125, 446/120, 121, 128
See application file for complete search history.

(56) References Cited

U.S. PATENT DOCUMENTS 1,385,154 A * 7/1921 Shields ..... A63H 33/084 446/124
3,480,054 A 11/1969 Marian
3,690,031 A 9/1972 Shinoda
3,701,214 A * 10/1972 Sakamoto ..... A63H 33/082 273/157 R
5,137,486 A * 8/1992 Glickman ..... A63H 33/062 446/124
5,322,467 A * 6/1994 Barzani ..... A63H 33/06 446/125
5,424,577 A 6/1995 Suzuki et al.
5,810,639 A 9/1998 Su
5,938,497 A * 8/1999 Mott ..... A63H 33/10 446/122

(Continued)

FOREIGN PATENT DOCUMENTS

GB 629169 A 9/1949
GB 2302662 A 1/1997

(Continued)

*Primary Examiner* — Alexander Niconovich
(74) *Attorney, Agent, or Firm* — Andrew Malarz, Esq.

(57) ABSTRACT

The invention relates to a modular education and toy block having at least one piece 10 having a body (11), a jointer (20) working with comb fitting principle (finger joint), having recesses and/or protrusions that each of them is in triangular on at least one surface of the joinder (20) which is appropriate to form new pieces (10) by combining the piece (10) with another piece (10).

27 Claims, 10 Drawing Sheets

(56) References Cited

U.S. PATENT DOCUMENTS

| | | | | |
|---|---|---|---|---|
| 6,511,073 | B2 * | 1/2003 | Simonds | A63F 9/0098 273/156 |
| 7,648,407 | B1 * | 1/2010 | Sorensen | A63H 33/084 446/120 |
| 8,424,577 | B2 * | 4/2013 | Poutanen | B27F 1/16 144/347 |
| 9,345,983 | B2 * | 5/2016 | Meys | A63H 33/062 |
| 9,517,423 | B1 | 12/2016 | Kanbar | |
| 2014/0270934 | A1 * | 9/2014 | Acerra | A63H 33/084 403/364 |
| 2015/0260206 | A1 * | 9/2015 | Acerra | A63H 33/084 403/364 |

FOREIGN PATENT DOCUMENTS

| | | | |
|---|---|---|---|
| WO | 9942190 | A1 | 8/1999 |
| WO | 2014128511 | A1 | 8/2014 |

* cited by examiner

MODULAR EDUCATION, ENTERTAINMENT AND TOY BLOCK

RELATED TECHNICAL FIELD OF THE INVENTION

This invention is related to an education, entertainment and toy block providing that different objects in unlimited amounts are created with the comb fitting (i.e.: finger joint) method by combining pieces in different geometrical shapes.

PRIOR ART

The modular multi piece construction toy sets which the users of all ages can use nowadays, which work with the combining principle are used popularly. There are types of said toy sets such that an imaginary or existing object is created due to their pieces in different geometry and sizes.

The toys that are sold under the trademarks of "Lego", "Mega Blocks" and "Duplo" from multi piece construction toy sets work with the principle that the cylindrical protrusions on the pieces are fitted into the cylindrical hollows in the same geometry which are present under the pieces again and they are fixed via friction. The pieces positioned one after the other can combine in the same direction or in the form that only a 90-degree angle is present between them. However, they do not have a connection variety and elasticity except of this. Generally, pieces which are rectangular prisms protect their own popularity due to the fact that children can use easily because of their large sizes and their models which are predetermined like movie, story characters or automobile, space shuttle; whose pieces are produced according to these objects; which is created according to a guide although they create limitation in creativity because their combination techniques are limited.

The toy group called "K'NEX" which is a more different type is based on the principle of combination of the pieces in different geometry by using interconnection rods. The toys consist of connection rods and pieces that can be created in circular or different shapes where more than one rod can be connected. It is used effectively in the toys that are predetermined and whose pieces are produced according to this. The most significant disadvantage of said toy pieces is that because they consist of only rods and pieces where they are connected, the toys which are in limited shapes and in a hollow structure can be created.

The toy groups in the prior art have limited geometries because of their combining structures. Although they allow to make objects in different types and sizes, they do not allow to make additions in different angles and geometries. Said toy blocks can be combined to the extent permitted by the slots in the blocks. For example, if protrusions set in the toy piece does not fit (not comply with) to recesses set in the other piece in Legos, combination cannot be carried out. Therefore, alternative toy pieces in limited amounts can be fitted to a protrusion set. This causes that the creativity of the user is limited.

In the documents with numbers of U.S. Pat. No. 8,424,577 (B2) and U.S. Pat. No. 3,480,054 (A) in the prior art, the comb fitting combination method which is designed over again according to the toy pieces in every geometry is mentioned.

In the documents with number of GB629169 (A) in the prior art, the toy blocks which are connected to each other with the comb fitting principle is mentioned.

BRIEF DESCRIPTION OF THE INVENTION

The purpose of this invention is to realize a modular education and toy block such that it allows to make addition from the same combination point to the same or different directions with the principle of comb fitting (finger joint) in toothed form which can provide combination in every direction and that provides creating new pieces by combining the toy pieces in different shapes.

The disclosed modular education and toy block of the invention comprises at least one piece having a body and a jointer which works with the comb fitting principle (finger joint), which has recess and/or protrusions that each of them is in triangular form on at least one surface of the piece which is suitable for creating new pieces by combining the piece with another toy piece.

The jointer comprises teeth in elastic and/or non-elastic form which are formed by recesses and protrusions.

The jointer comprises teeth in the form of an inner tooth created by the recesses formed inwards from the body and/or an outer tooth created by the protrusions formed outwards from the body.

At least one teeth row comprising the inner teeth and another at least one teeth row having the outer teeth are combined with each other smoothly.

At least one teeth row comprising the outer teeth and another at least one teeth row comprising the outer teeth are combined with each other smoothly.

The jointer can comprise the inner teeth row and the outer teeth row on the same body.

The teeth are made of a material different from the body. The jointer is made of a material softer than the body on the purpose of obtaining a more elastic combination.

The jointer has the teeth which is fixed onto the surface of the piece which the part of the jointer that is the base of the recesses and protrusions in triangular form creating the teeth belongs to and where the ends of the triangular form are free.

The disclosed modular education and toy block of the invention comprises at least one jointer whose free ends comprise sharp teeth. The disclosed jointer comprises at least one teeth row.

The jointer can comprise teeth rowed in linear form and/or circular and/or spiral form.

The teeth rows included by the jointer are parallel to each other.

The length (depth) of the teeth included by the jointer and the width between each of two consecutive protrusions of the jointer are same with each other.

The tooth width included by the teeth row can be different from each other for each piece.

The jointer comprises toothed rows where the pieces can be combined to the same or different directions on the same plane or where the pieces can be combined on different planes and in different directions.

In the main embodiment of the invention, the jointer and toy piece are positioned as a single piece.

The jointer has the teeth made of plastic, wood, metal and composite materials and said teeth are produced with technique of flaring with knife or production with mold.

The toy piece comprises at least one jointer such that it provides combination with another piece on at least one surface of the toy piece.

In an embodiment of the invention, the toy piece comprises jointers on all surfaces of the toy piece continuously.

Inter combination unit can combine a toothed jointer and a female recessed tab. The inter combination unit is a connector combining a tab that has two recesses or a tab that has two protrusions.

To provide a better combination, the lateral surfaces of the inter combination unit are in a rough structure and in a form that they are suitable for the tooth widths.

The combination technique applied in the disclosed modular education and toy block of the invention provides a smooth combination that is more natural and does not oblige to grow in a certain direction.

The comb fitting (finger joint) structure used in the disclosed modular education and toy block of the invention does not need an additional adhesive.

DETAILED DESCRIPTION OF THE INVENTION

Figure 1:
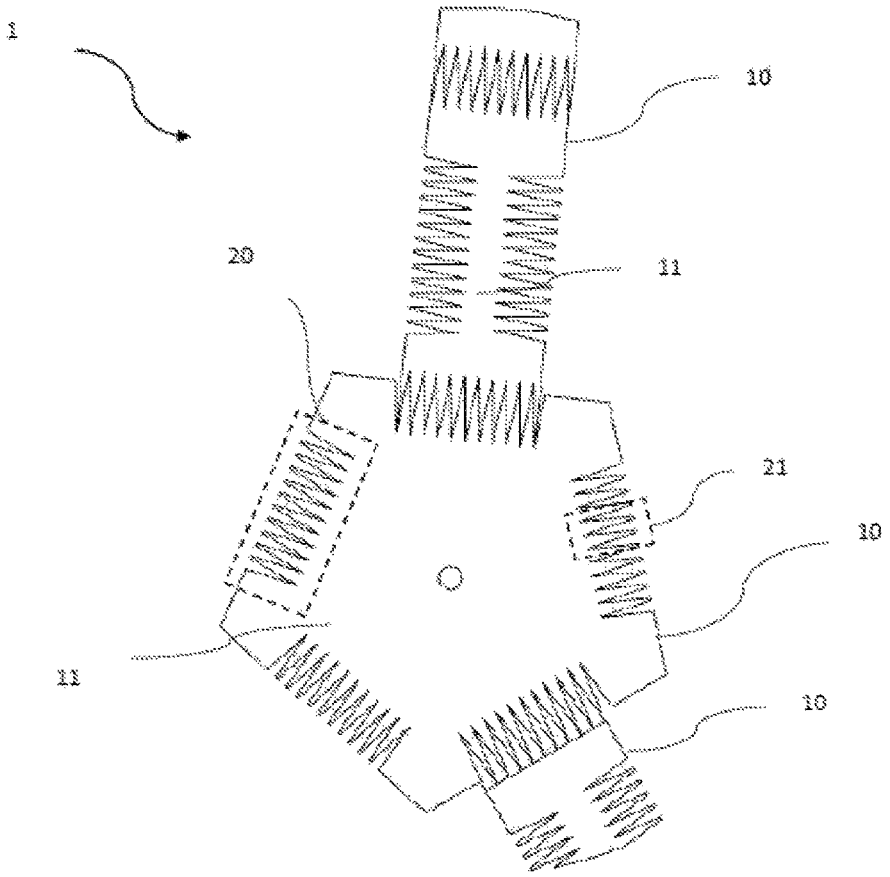
FIG. 1—It is the schematic view of the units comprising the toothed jointers where the pieces that construct the disclosed modular education and toy block of the invention are combined in one dimension.
Figure 2:
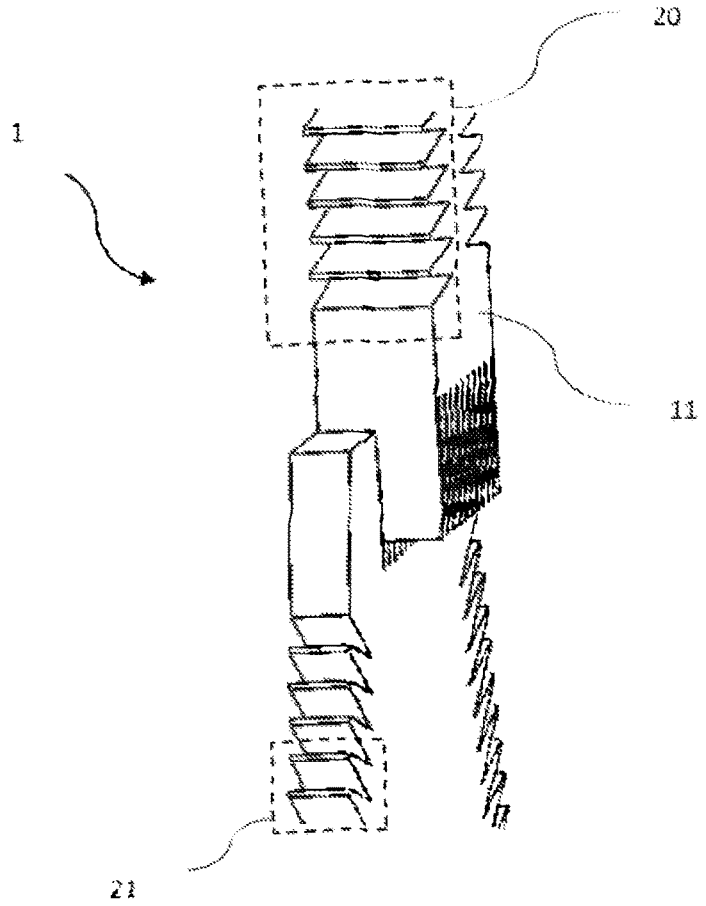
FIG. 2—It is the schematic view of an embodiment where the toothed jointers in different widths are combined in the disclosed modular education and toy block of the invention.
Figure 3:
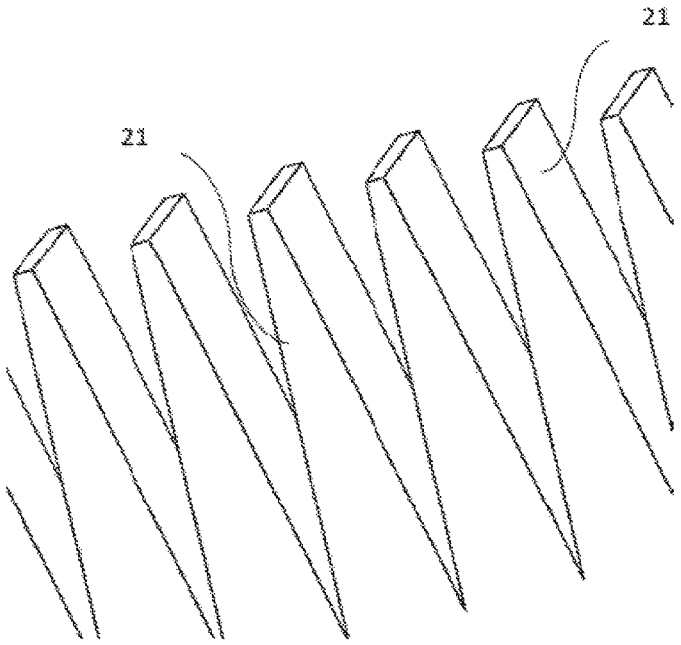
FIG. 3—It is the schematic view of the toothed jointers in the disclosed modular education and toy block of the invention.

The numbers of the parts in the disclosed modular education and toy group of the invention in the figures are shown below:

1. Modular education and toy group
- 10. Piece
  - 11. Body
- 20. Jointer
  - 21. Teeth
    - 210. Inner tooth
    - 211. Outer tooth
- 30. Inter combination unit The disclosed modular education and toy block (1) of the invention comprises toy pieces (10) in various shapes and sizes and a jointer (20) in tooth (21) form having recesses and protrusions in triangular form providing that these pieces (10) are combined in every direction and shape and an inter combination unit (30) used to combine female-female surfaces.

The pieces (10) included by the disclosed modular education and toy block (1) of the invention comprise toothed (21) jointers (20) and a body (11). In the main embodiment of the invention, a unit (10) comprises at least one jointer (20) positioned as a single piece and a body (11).

In an embodiment of the invention, the pieces (10) can comprise both toothed (21) jointers (20) and tabs.

The disclosed tabs comprise protrusions in male form or recesses in female form.

The jointer (20) comprises at least one teeth row. The teeth (21) row can be linear or circular or spiral. The teeth (21) comprise protrusions in triangular form and recesses formed between these protrusions.

The teeth (21) row comprises two types of tooth (21) such as inner teeth (210) and outer teeth (211).

The inner teeth (210) are the teeth (21) created by the recesses formed inwards from the body (11).

The outer teeth (211) are the teeth (21) created by the protrusions formed outwards from the body (11).

The teeth (21) are in a form that they are fixed onto the surface of the piece (10) which the part which is the base of its triangular form belongs to and that the ends of the triangular form are free. The free ends of the disclosed teeth (21) are in a form that gets narrow and/or pointed according to the part where they are fixed.

The teeth (21) which fit to each other are in the same geometry and angle with each other.

The jointer (20) can be produced from a material softer than the body (11) on the purpose of obtaining a better combination. Therefore, a more elastic combination is provided between the pieces (10).

The toy pieces (10) in various shapes comprising the jointer (20) on at least one edge of the toy piece (10) and the teeth (21) included by the disclosed jointers (20) can be combined with each other in every direction and shape.

A jointer (20) comprising inner teeth (210) and another jointer having outer teeth (211) are combined in every shape from any desired region of the toy piece (10) to every direction one or multi dimensionally. Combining of a teeth (21) row comprising inner teeth (210) with another teeth (21) row having outer teeth (211) provides combination of two toy pieces (10) with each other smoothly without remaining any space between them.

Also, it is provided that the toy blocks (1) are created in every direction and shape by combining two pieces (10) comprising outer teeth (211) row with each other.

The body (11) can comprise both single and/or multi tooth (21) rowed jointers (20) having inner teeth (210) and single and/or multi tooth (21) rowed jointers (20) having outer teeth (210).

Therefore, comb fittings (finger joint) with different properties can be carried out with the jointers (20) having different tooth (21) row on the same body (11).

The inter combination unit (30) is an interconnection component. The disclosed inter combination unit (30) is used to combine the recessed structures (female-female) formed between protrusions that the teeth (21) have in the inner tooth (210) and/or outer tooth (211) rows.

In addition, the circularly rowed tooth structures (21) that can combine with each other also can combine with the tooth structures (21) that are not circularly rowed as well due to the inter combination unit (30).

The lateral surface of the inter combination unit (30) is in a rough form increasing friction. Also, the inter combination unit (30) is in an appropriate width for tooth (21) widths.

The distance between teeth (21) and the depth of teeth (21) are determined equally on the purpose of providing fitting of every piece (10) to each other. The tooth (21) widths of the toy piece (10) in itself are same but the tooth (21) widths in different pieces can be different from each other. In addition, the pieces (10) comprising the jointer (20) that has tooth (21) rows with different widths can be combined with each other.

Two toy pieces (10) with the jointer (20) having wider and narrower tooth (21) structures can be combined due to the teeth (21) with the same depths.

Figure 4:
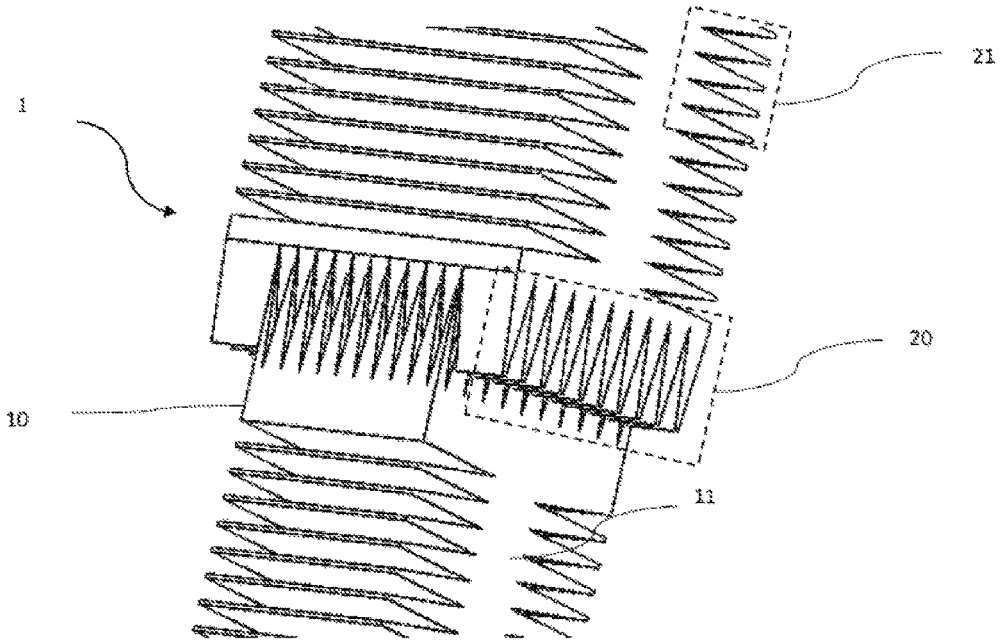
FIG. 4—It is the schematic view of the toothed structures which are perpendicular to each other in the disclosed modular education and toy block of the invention.
Figure 5:
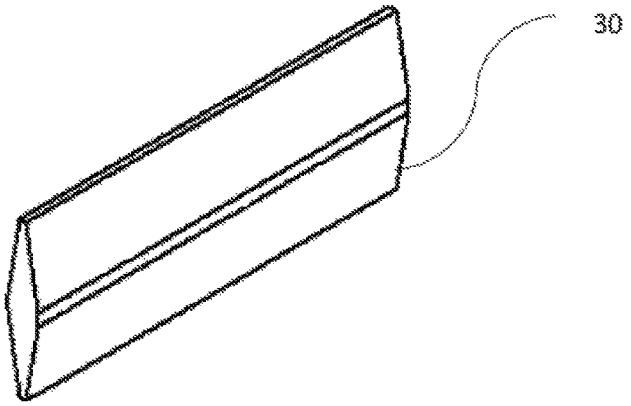
FIG. 5—It is the schematic view of the inter combination unit in the disclosed modular education and toy block of the invention.

In another embodiment of the invention in the FIG. 4, it is provided that new toy pieces (10) which is created grow three dimensionally due to the jointers (20) comprising teeth structures (21) perpendicular to each other. Thus, it is aimed that users create the structures that they imagine without adhering two dimensions.

Figure 6:
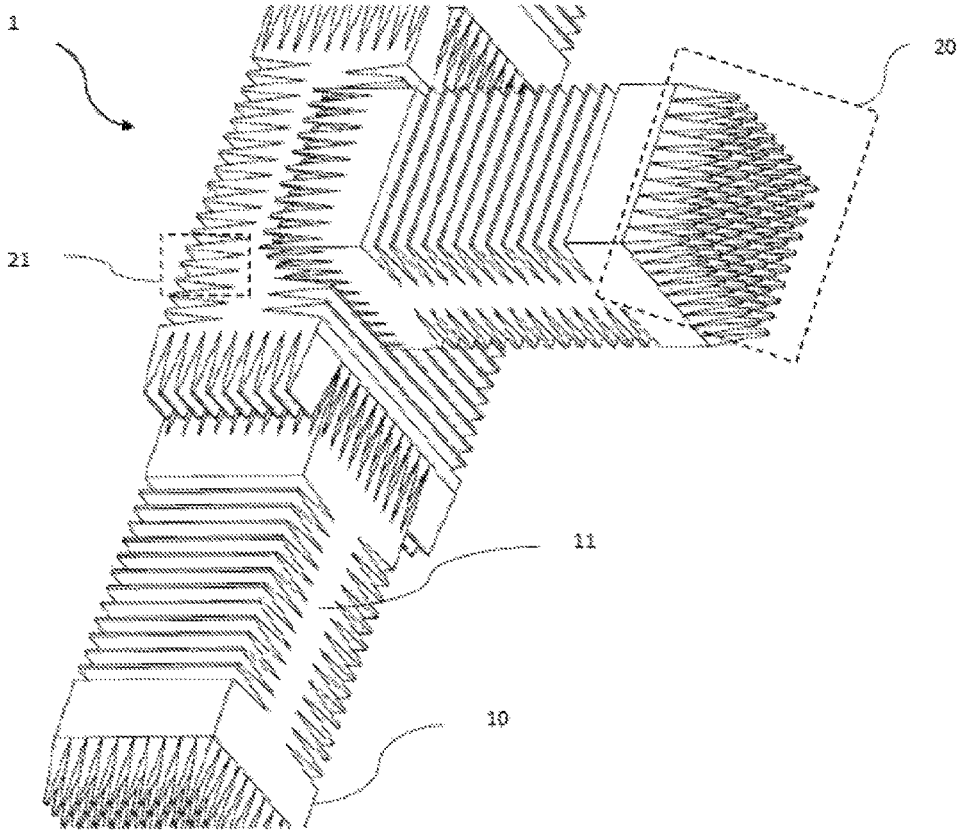
FIG. 6—It is the schematic view of the structure with multidirectional toothed jointer in an embodiment of the disclosed modular education and toy block of the invention.

The jointers (20) having multi teeth (21) rows and a piece (10) can be connected to the other pieces (10) from a desired tooth (21) row as well as the jointers (20) may have a single teeth (21) row. Therefore, a chance of combination with more sensitive measurement is provided during construction of the units (10) to each other and the construction independence of the user increases on behalf of the measurement. An example of this is shown in the FIG. 6. Also, the combinations which are 90 degrees perpendicular to the toy piece (10) are provided by creating these tooth rows (21) diagonally. Thus, a piece (10) can be used as a multidirectional connection point. The pieces (10) which grow to different directions can be fitted to this connection point.

In the disclosed modular education and toy block (1) of the invention, one directional tooth (21) row systems also give chance for the connection of more than one piece (10). One directional tooth (21) row is a toothed (21) structure allowing combination in only one direction; however, it is provided that the toy pieces (10) are combined very diversely in every direction by using the advantage of the teeth (21) with different width.

Creating a new piece (10) is seen as a result of combination of the toy piece (10) in rectangular prism form comprising jointers (20) on four sides of the toy piece (10) which is an example of an embodiment of the invention in the FIG. 1 with another toy piece (10) in pentagonal form comprising jointers (20) on all edges of the toy piece (10) again on the same plane. Additions can be made to this new piece (10) created with idle jointers (20) which are not combined with any units (10).

Figure 7:
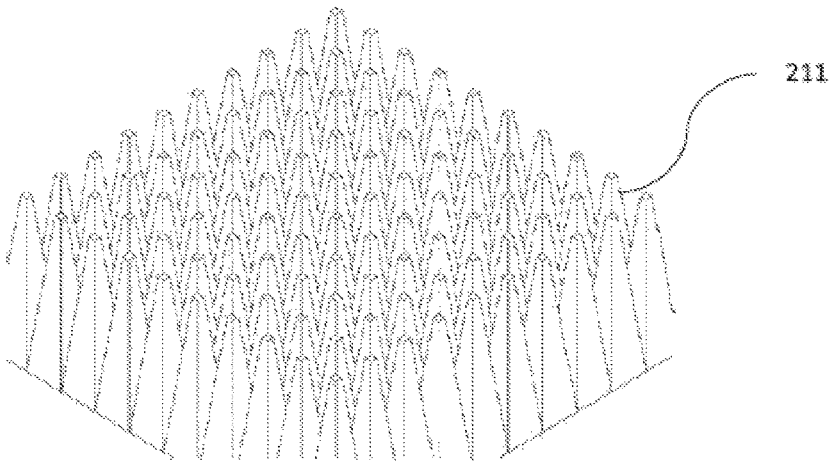
FIG. 7—It is the schematic view of a jointer of the disclosed modular education and toy block of the invention comprising outer teeth which provide combination to every direction.

In another embodiment of the invention in the FIG. 7, a block (1) created by combining lots of different toy pieces (10) is shown. A new piece (10) in star form is created by fitting triangular pieces (10) to a pentagonal toy piece (10). A level difference between these pieces (10) combined with the toothed (21) jointers (20) does not occur after they are combined. Therefore, more natural and regular structures develop. The systems provided due to the pieces (10) that allow big and many multiple connections; the construction of new blocks (1) are provided via attaching many pieces (10) with regard to the central piece (10).

Figure 8:
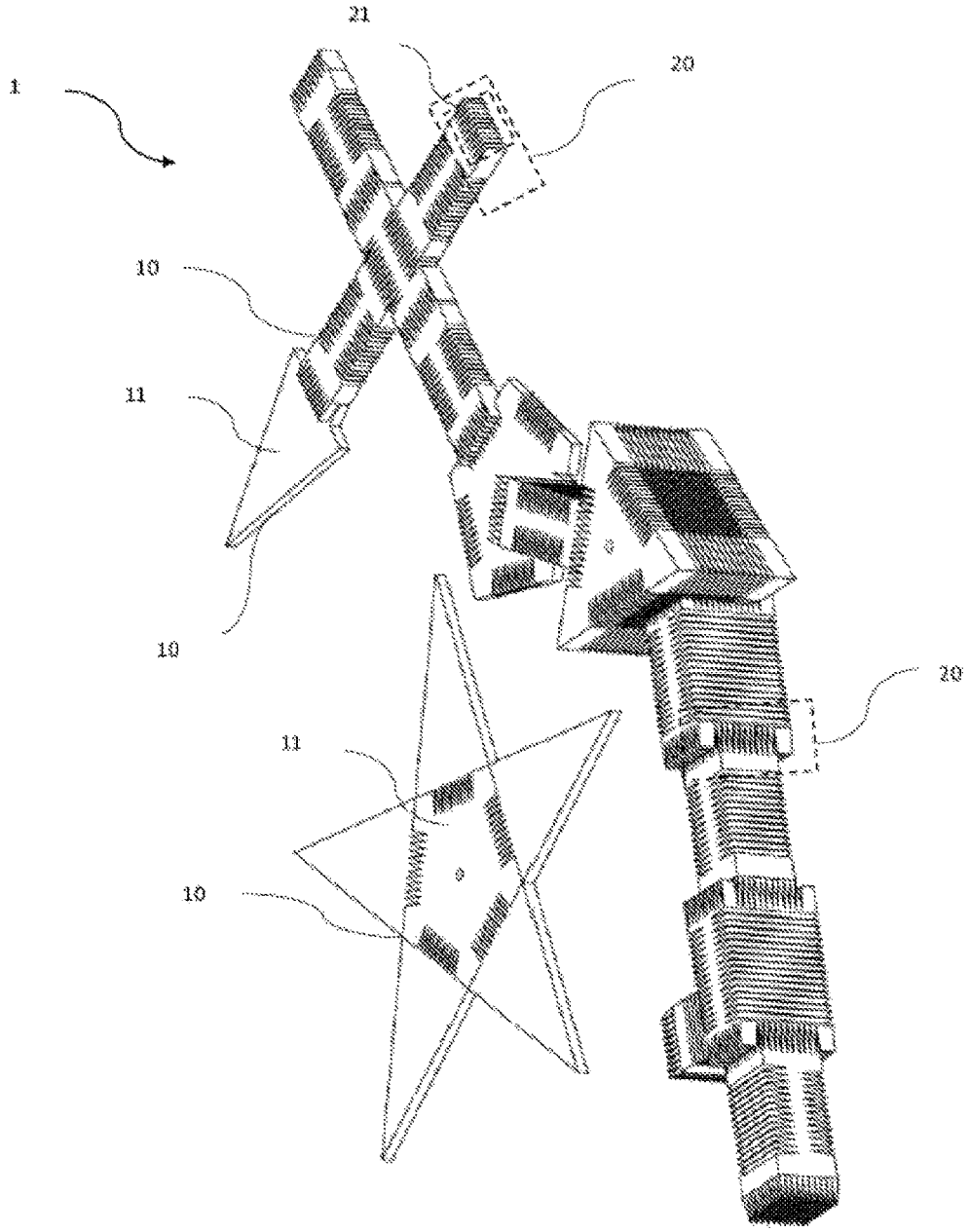
FIG. 8—It is the schematic view of an embodiment of the disclosed modular education and toy block of the invention which is constructed with the toothed jointers.
Figure 9:
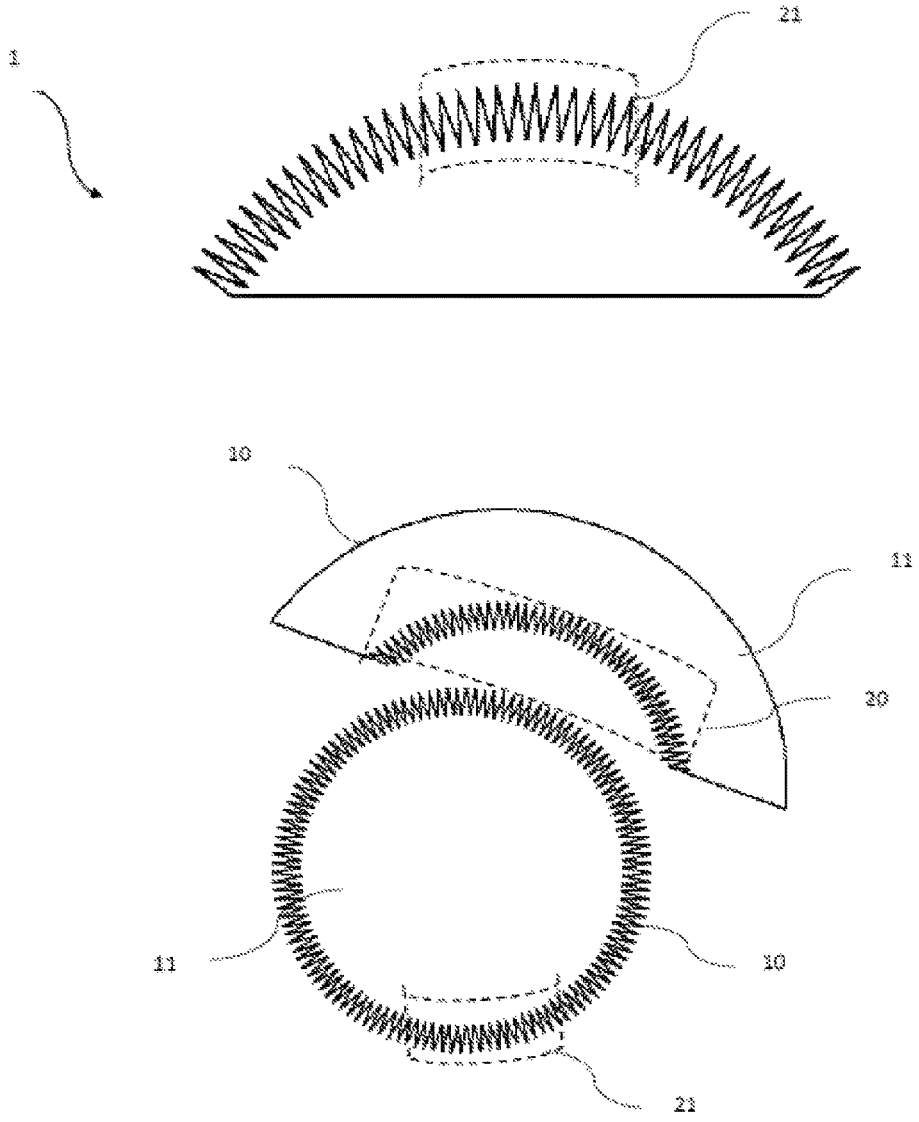
FIG. 9—It is the schematic view of the pieces in circular form in an embodiment of the disclosed modular education and toy block of the invention.

In another embodiment of the invention in the FIGS. 8 and 9, new pieces (10) in various shapes can be created also with pieces in oval form except of the pieces (10) in cornered geometry due to the toothed (21) jointer (20). The jointers (20) with rowed teeth (21) in circular form included by the toy pieces (10) in semicircular or full circular form on their outer surfaces comprising rowed teeth (21) can be combined with the pieces (10) in semicircular form with rowed teeth (21) whose inner edge is in circular form.

Figure 10:
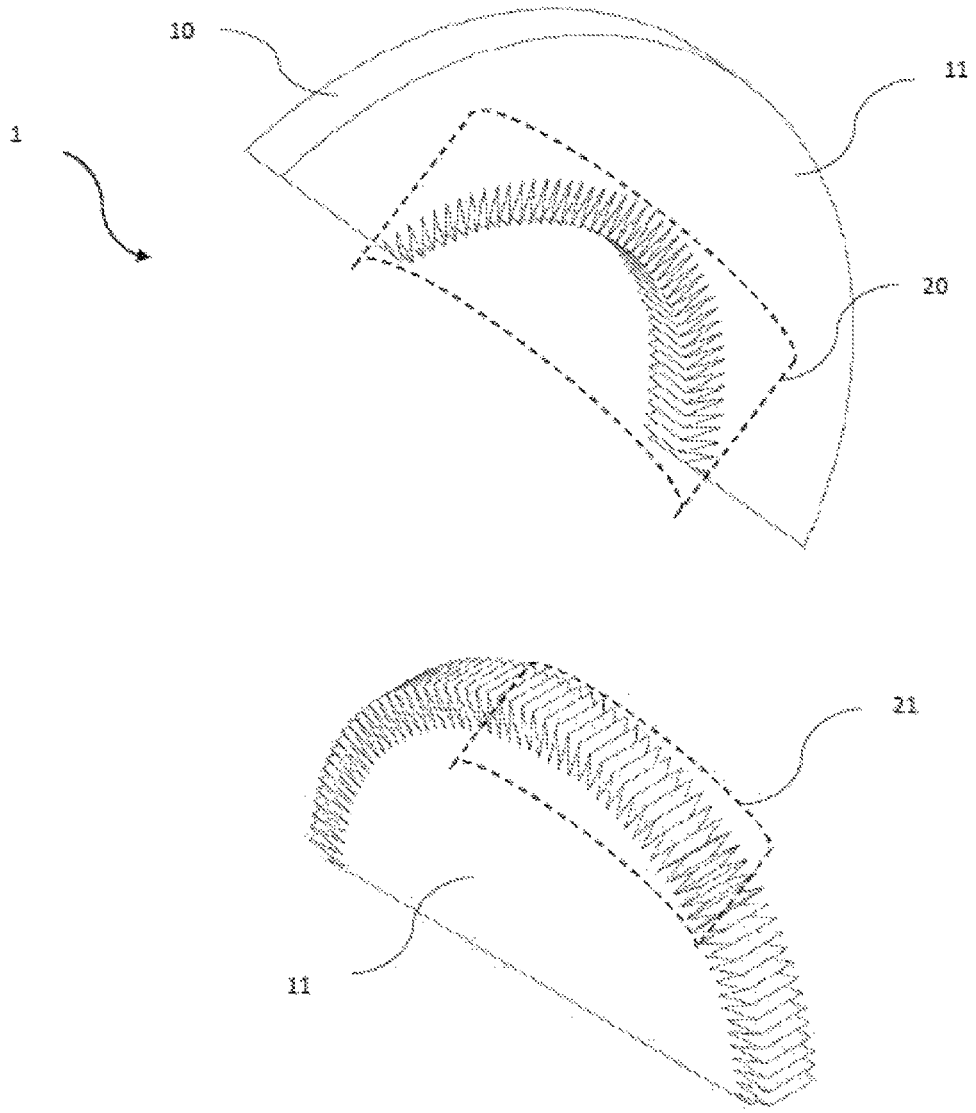
FIG. 10—It is the three dimensional schematic view of the pieces in circular form in an embodiment of the disclosed modular education and toy block of the invention.
Figure 11:
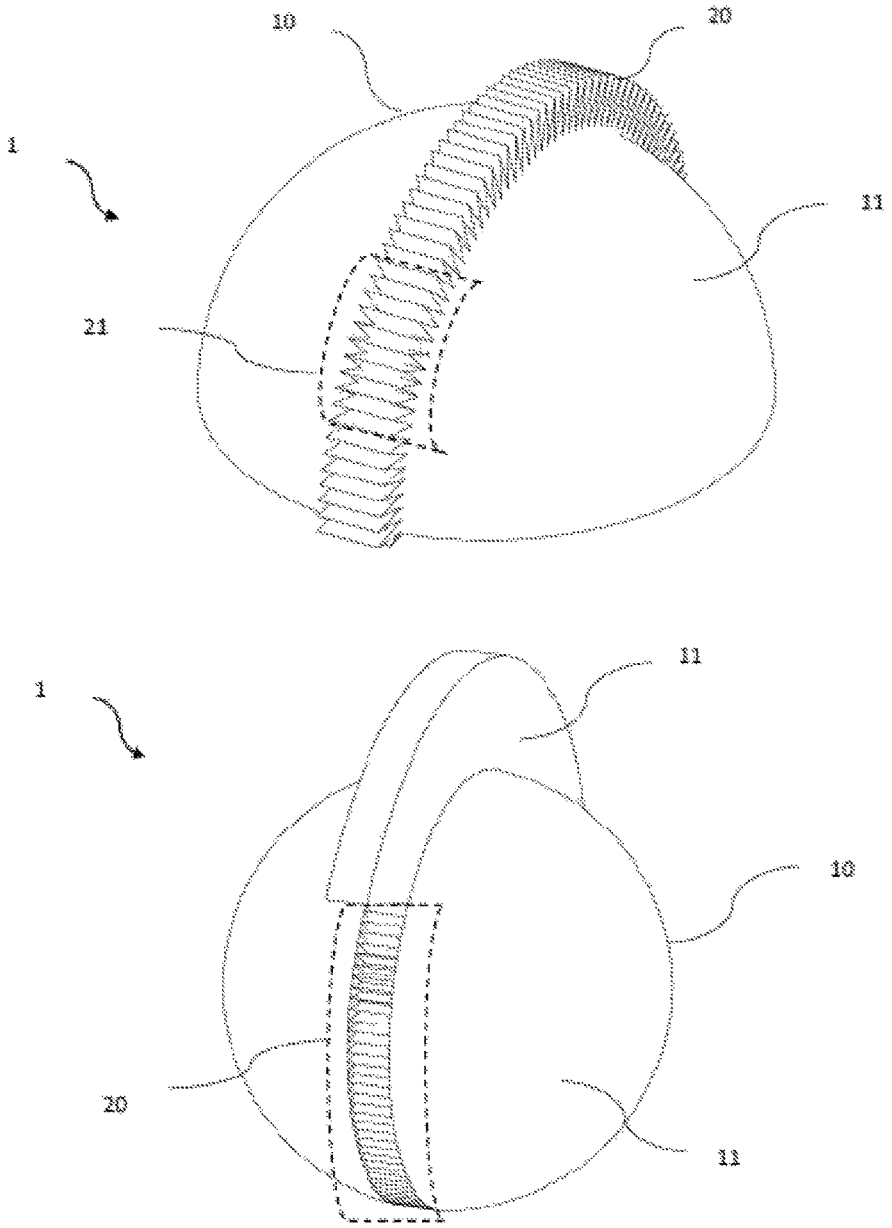
FIG. 11—It is the schematic view of the pieces in spherical form in another embodiment of the disclosed modular education and toy block of the invention.
Figure 12:
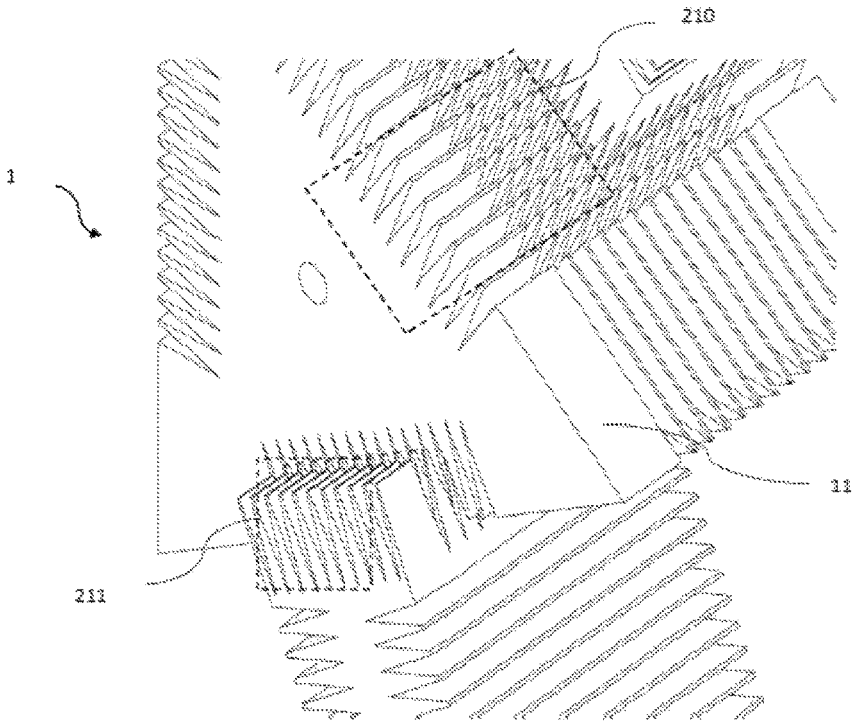
FIG. 12—It is the schematic view of the disclosed modular education and toy block of the invention in an embodiment of it where inner toothed and outer toothed jointers are combined.
Figure 13:
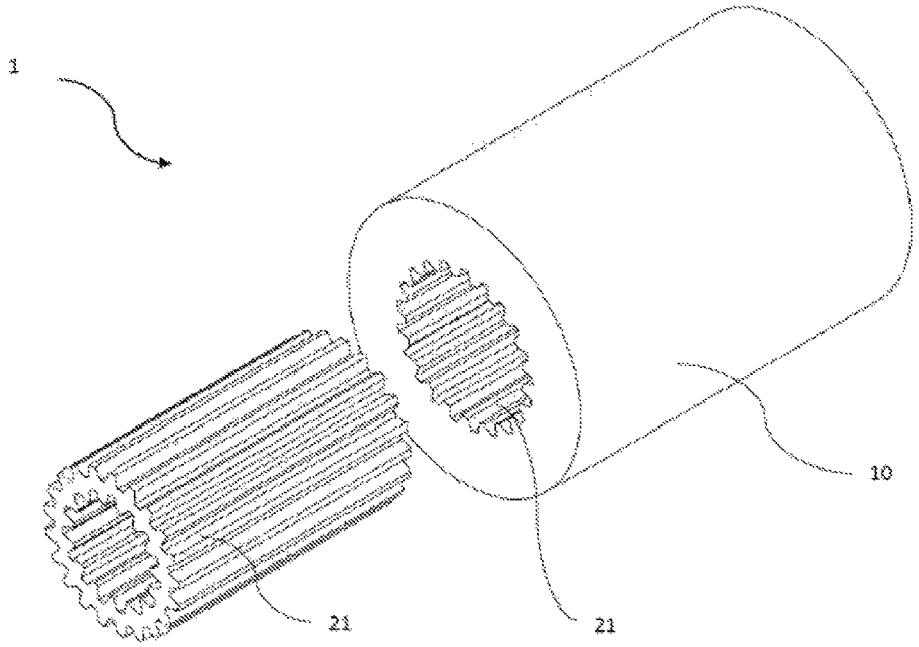
FIG. 13—It is the schematic view where the pieces in cylindrical form in an embodiment of the disclosed modular education and toy block of the invention are combined.

In the example of an embodiment of the invention in the FIG. 10, it is shown that a toy piece (10) in cylindrical form whose all surfaces comprise jointers (20) and another toy piece (10) whose all inner surface comprises a continuous jointer (20) can be combined in the form that they can intertwine.

In alternative embodiments of the invention, the toy pieces (10) in semispherical or full spherical form comprising rowed teeth (21) structures which are outwards or embedded inwards on the axis of the toy pieces can be combined with each other. These tooth (21) rows can surround all around the sphere and also they are positioned on a specific region of it. An example of these embodiments where circular pieces (10) and spherical pieces (10) can be combined with each other is shown in the FIG. 10.

The ends of the teeth (21) are in the form that they do not damage to human body and possible injuries are prevented by avoiding sharp structures. In addition, the teeth (21) are in a robust and elastic form such that it prevents breaking.

The teeth (21) included by the disclosed modular education and toy block (1) of the invention are made of plastic, wood, metal and composite materials.

The teeth (21) can be produced with technique of flaring with knife or production with mold.

The toothed (21) jointer (20) allows the combination of not only geometrical figures but also any object having a teeth (21) structure. For example, the units (10) that human models having a tooth (21) structure are created can be combined with each other.

The invention is not limited with the embodiments disclosed above and a skilled person in the art can perform different embodiments of the invention easily. They should be evaluated within the scope of the invention protection demanded with claims.

The invention claimed is:

1. A modular education and toy block (1) comprising
at least one piece (10) having
a body (11), and
a jointer (20) which is suitable for creating
new pieces (10) by combining the piece (10) with
another piece (10), wherein each joiner (20) has
multiple teeth rows,
having multiple-teeth in triangular form on each row which forms
multiple comb shapes such that jointer (20) allows the pieces (10) to combine in different directions and on different planes and in different angles, wherein multiple teeth rows spread over both lengthwise and crosswise of the jointer (20).

2. The modular education and toy block (1) according to claim 1, wherein
the jointer (20) has
teeth (21) in elastic form which a recesses and protrusions create.

3. The modular education and toy block (1) according to claim 1, wherein
the jointer (20) has
teeth (21) in the form of inner tooth (210) created by recesses formed inwards from
the body (11) or in the form of
an outer tooth (211) created by
protrusions formed outwards from the body (11).

4. The modular education and toy block (1) according to claim 3, wherein
the jointer (20) provides smooth combination of at least one teeth row (21) comprising
inner teeth (210) and another
at least one teeth row (21) having
outer teeth (211) with each other.

5. The modular education and toy block (1) according to claim 4, wherein
different jointers-(20) have
an inner teeth row (210) and
an outer teeth (211) on
the same body (11).

6. The modular education and toy block (1) according to claim 3, wherein
jointer (20) provides smooth combination of at least one teeth row (21) comprising
outer teeth (211) and
another at least one teeth row (21) comprising
outer teeth (211) with each other.

7. The modular education and toy block (1) according to claim 1, wherein
the jointer (20) has
teeth (21) made of a material different from the body (11).

8. The modular education and toy block (1) according to claim 7, wherein
the jointer (20) made of a material softer than
the body (11) for a purpose of obtaining a more elastic combination.

9. The modular education and toy block (1) according to claim 1, wherein
the jointer (20) has
teeth (21) which is fixed onto a surface
of the piece (10) which the part of the jointer (20) that is
a base of the recesses and protrusions in triangular form creating the teeth (21) belongs to and where
ends of the triangular form are free.

10. The modular education and toy block (1) according to claim 9, wherein
at least one jointer (20) has free ends that comprise
the teeth (21).

11. The modular education and toy block (1) according to claim 1, wherein the jointer (20) comprises teeth (21) rowed in linear form.

12. The modular education and toy block (1) according to claim 11, wherein
the jointer (20) comprises
teeth rows (21) which are parallel to each other.

13. The modular education and toy block (1) according to claim 12, wherein
the jointer (20) comprises
the teeth (21) having protrusions with same depth lengths.

14. The modular education and toy block (1) according to claim 13, wherein
the jointer (20) comprises
the teeth row (21) whose widths between each of two consecutive protrusions are same with each other.

15. The modular education and toy block (1) according to claim 14, comprising
the jointer (20), wherein
tooth (21) widths of teeth rows (21) are different from each other for each piece (10).

16. The modular education and toy block (1) according to claim 15, comprising
the jointer (20) comprising the teeth rows (21),
wherein pieces (10) can be combined to the same direction or different directions on a same plane.

17. The modular education and toy block (1) according to claim 16, comprising the jointer (20) and a piece (10) positioned as a single piece.

18. The modular education and toy block (1) according to claim 17, comprising
the jointer (20) having
teeth (21) made of plastic, wood, metal or composite materials.

19. The modular education and toy block (1) according to claim 18, comprising
the jointer (20) having
teeth (21) produced with a technique of flaring with knife or production with mold.

20. The modular education and toy block (1) according to claim 1, wherein
the jointer (20) comprises
teeth (21) rowed in circular or spiral form.

21. The modular education and toy block (1) according to claim 1, comprising
at least one piece (10) comprising at least
one jointer (20) in a form that provides combination from all surfaces of the piece (10) with another piece (10).

22. The modular education and toy block (1) according to claim 21, comprising
a piece (10) comprising the jointer (20) on all surfaces of the piece (10).

23. The modular education and toy block (1) according to claim 22, comprising
cylindrical, spherical and circular pieces (10) in the form that can intertwine comprising
the jointer (20) on all surfaces of the pieces (10) continuously.

24. The modular education and toy block (1) according to claim 1, comprising
an inter combination unit (30) combining a toothed (21) jointer (20) with a female recessed tab.

25. The modular education and toy block (1) according to claim 24, comprising an inter combination unit (30) combining two tabs having recesses.

26. The modular education and toy block (1) according to claim 25, comprising an inter combination unit (30) combining two tabs having protrusions.

27. The modular education and toy block (1) according to claim 24, comprising an inter combination unit (30) which is in a suitable form for tooth widths and whose lateral surfaces are in rough form to provide a better combination.

* * * * *